US011965510B2

(12) United States Patent
Yorikane et al.

(10) Patent No.: US 11,965,510 B2
(45) Date of Patent: Apr. 23, 2024

(54) COMPRESSOR BODY AND COMPRESSOR TO SUPPLY LIQUID INTO WORKING CHAMBERS AND WHOSE DOWNSTREAM PORTION REACHES A SUCTION BEARING CHAMBER

(71) Applicant: Hitachi Industrial Equipment Systems Co., Ltd., Tokyo (JP)

(72) Inventors: Shigeyuki Yorikane, Tokyo (JP); Masahiko Takano, Tokyo (JP); Kenji Morita, Tokyo (JP); Yoshitaka Takeuchi, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 17/773,184

(22) PCT Filed: Sep. 28, 2020

(86) PCT No.: PCT/JP2020/036529

§ 371 (c)(1),
(2) Date: Apr. 29, 2022

(87) PCT Pub. No.: WO2021/084996

PCT Pub. Date: May 6, 2021

(65) Prior Publication Data

US 2022/0372982 A1 Nov. 24, 2022

(30) Foreign Application Priority Data

Oct. 31, 2019 (JP) ..... 2019-198157

(51) Int. Cl.
*F04C 29/00* (2006.01)
*F04C 18/16* (2006.01)
*F04C 29/02* (2006.01)

(52) U.S. Cl.
CPC ..... *F04C 29/0007* (2013.01); *F04C 18/16* (2013.01); *F04C 29/02* (2013.01); *F04C 2240/30* (2013.01); *F04C 2240/52* (2013.01)

(58) Field of Classification Search
CPC ..... F04C 2/16; F04C 18/16; F04C 15/0088; F04C 15/0092; F04C 29/0007; F04C 29/0014; F04C 29/02–028; F04C 29/042; F01C 1/16; F01C 21/001; F01C 21/002; F01C 21/04–045
See application file for complete search history.

(56) References Cited

U.S. PATENT DOCUMENTS

| | | | | |
|---|---|---|---|---|
| 4,211,522 A * | 7/1980 | Pidgeon | F04C 29/02 418/99 |
| 2018/0023571 A1* | 1/2018 | Endo | F04C 18/16 418/202 |
| 2019/0032666 A1* | 1/2019 | Mikulic | F04B 39/0207 |
| 2019/0093659 A1 | 3/2019 | Crum et al. | |
| 2019/0170143 A1 | 6/2019 | Chiba et al. | |

FOREIGN PATENT DOCUMENTS

| | | | |
|---|---|---|---|
| GB | 1599413 A * | 9/1981 | F04C 29/02 |
| JP | 52-135407 A | 11/1977 | |

(Continued)

OTHER PUBLICATIONS

International Search Report (PCT/ISA/210) issued in PCT Application No. PCT/JP2020/036529 dated Nov. 24, 2020 with English translation (five (5) pages).

(Continued)

*Primary Examiner* — Laert Dounis
(74) *Attorney, Agent, or Firm* — Crowell & Moring LLP

(57) ABSTRACT

A compressor body includes a compression mechanism including a screw rotor that compresses gas, a casing that accommodates the compression mechanism and defines a compression working chambers therein, a suction side bearing that rotatably supports the screw rotor, a bearing chamber that accommodates the suction side bearing, and a liquid supply port that communicates with the compression working chambers and supplies liquid supplied from the outside (Continued)

of the casing into the compression working chambers. The casing has an internal liquid supply flow path that extends from a discharge side of the compression working chambers as an upstream side to a suction side of the compression working chambers as a downstream side and that supplies the liquid to the liquid supply port. The internal liquid supply flow path has a downstream portion reaching the bearing chamber and supplies the liquid to the suction side bearing.

11 Claims, 8 Drawing Sheets

(56) References Cited

FOREIGN PATENT DOCUMENTS

| | | | | |
|---|---|---|---|---|
| JP | 57-76298 | A | | 5/1982 |
| JP | 2018197531 | A | * | 12/2018 |
| WO | WO 2018/038070 | A1 | | 3/2018 |
| WO | WO 2019/093106 | A1 | | 5/2019 |

OTHER PUBLICATIONS

Japanese-language Written Opinion (PCT/ISA/237) issued in PCT Application No. PCT/JP2020/036529 dated Nov. 24, 2020 (five (5) pages).

International Preliminary Report on Patentability (PCT/IB/338 & PCT/IB/373) issued in PCT Application No. PCT/JP2020/036529 dated May 12, 2022, including English translation (Japanese-language Written Opinion (PCT/ISA/237), filed on Apr. 29, 2022) (seven (7) pages).

* cited by examiner

COMPRESSOR BODY AND COMPRESSOR TO SUPPLY LIQUID INTO WORKING CHAMBERS AND WHOSE DOWNSTREAM PORTION REACHES A SUCTION BEARING CHAMBER

TECHNICAL FIELD

The present invention relates to a compressor body and a compressor, and particularly to a compressor body and a gas compressor of the liquid flooded type in which liquid is supplied into compression working chambers when compression medium is to be compressed.

BACKGROUND ART

Among compressors that suck compression medium such as air or some other gas, compress the compression medium, and discharge the compressed gas, liquid flooded type compressors are known in which liquid such as oil or water is supplied into compression working chambers and compressed gas of gas-liquid mixture is discharged together with the compression medium. A liquid flooded type compressor in which liquid is supplied into the compression working chambers via a liquid supply port formed in a casing of a compressor body is known.

A liquid flooded type compressor is described using, for example, an oil flooded type screw compressor. In the oil flooded type screw compressor, a compressor body includes one or a plurality of helical screw rotors and a body casing having an internal space of a shape with substantially the same diameter as a lobe tip diameter of this rotor (these rotors), and has a compression working chambers defined by the rotor (rotors) and a bore inner wall of the internal space. Compression medium sucked in a compression working chamber is compressed by decrease in the volume of the compression working chamber by rotation of the rotor (rotors).

As a pressure source for supplying liquid such as oil to the compressor body, a pressure feeding apparatus such as a self-excited or separately-excited pump is used or the pressure of compressed gas discharged from the compressor body is utilized, frequently. In the latter case, there is provided a recirculation path from a gas-liquid separator, which separates compressed gas of gas-liquid mixture discharged from the compressor body into gas and liquid, to an oil flow path of the compressor body. The separated oil is pressure fed to the compressor body side by discharge pressure applied to the inside of the gas-liquid separator.

Some compressor casings are known to have an oil flow path to which oil is supplied from the outside of the compressor body and be configured such that the oil is supplied into the compression working chambers via an oil supply port that penetrates the bore inner wall and communicates with the compression working chambers. Oil is supplied to the compression working chambers generally in order to cool the compression gas, lubricate the screw rotor, and improve the sealing of a gap between the screw rotor (including, where a plurality of rotors are involved, a gap between the rotors) and the bore wall face of the compressor casing (liquid supplied into the compression working chambers or the like in this manner is hereinafter referred to sometimes as "lubricant").

As an oil supply port that is arranged at the bore inner wall and communicates with the compression working chambers, various types are known such as a single hole with a predetermined diameter and a hole that supplies oil in the form of mist. Patent Document 1 discloses an oil supply port that injects oil in a striped shape from two or more holes having orientations crossing with each other on a compression working chamber side such that the two stripes of the oil impinge on each other at a crossing point to form oil to be supplied in the form of fine particles (in the form of mist). Meanwhile, Patent Document 2 discloses a mechanism that causes oil injected in one direction from a single thin hole to impinge on a face inclined with respect to the one direction such that oil of a small particle size is injected into the compression working chambers.

In a liquid flooded type compressor, such lubricant as described above is utilized also as lubricant for a bearing and so forth for rotatably supporting the screw rotor (also there is a case where the lubricant is utilized for lubrication of a gear mechanism and so forth for transmitting rotational power to the screw rotor). Specifically, the screw rotor is rotatably supported on the compressor casing through bearings at rotator shaft sections on the load side and the anti-load side (or, in some cases, on one of the sides) of the compressor body. Also a general configuration of the liquid flooded type compressor that uses liquid such as oil or water to be supplied to the compression working chambers as lubricant for bearings as described above is. For example, the configuration mentioned could be a configuration in which the compressor casing has a branch path that communicates with the compression working chambers and supplies the oil into a bearing chamber and in which lubricant is supplied through the branch path to the bearing chamber, a configuration in which oil for bearings and oil for the compression working chambers are supplied individually through different external pipes connected to the compressor casing, or the like.

PRIOR ART DOCUMENT

Patent Documents

Patent Document 1: WO 2018/038070 A1
Patent Document 2: US 2019/0093659 A1

SUMMARY OF THE INVENTION

Problems to be Solved by the Invention

In a case of a configuration in which a lubricant flow path for supplying liquid to a bearing chamber that accommodates a bearing or the like and a flow path for supplying liquid to compression working chambers are branched from a supply pipe for lubricant, it is necessary to take the following problems into consideration.

Firstly, there is a problem about optimization of the temperature of liquid to be supplied to the bearing chamber and the temperature of liquid to be supplied to the compression working chambers. For example, liquid separated by the gas-liquid separator is thereafter recirculated into the compressor body and supplied separately to the bearing chamber and the compression working chambers. Immediately after the liquid is supplied to both chambers, the liquid temperatures of both sides are substantially equal to each other. Even if the temperatures are a temperature suitable for cooling of the compressed gas in the compression working chambers, lubricating of the screw rotor, and sealing of a gap, the temperatures are sometimes different from a temperature where the liquid has such a viscosity that rotation loss of the bearing in the bearing chamber become less. That is, the temperature suitable for liquid to be supplied to the compression working chambers tends to be lower than the temperature where the viscosity is suitable against the rotation loss of the bearing. There is a problem that the balance between the compressibility and the rotation loss of the screw rotor is one-sided to one of them (if a liquid temperature is set so as to prioritize the lubricity of the bearing, then this may give rise to deterioration in compression efficiency or cooling of gas). Such a problem as just described tends to be seen in regard to a bearing on the anti-load side, which is relatively low temperature.

For this problem, if a cooling mechanism for exclusive use is provided in the liquid flow path for supplying liquid to the compression working chambers, it is possible to individually manage the temperatures of the liquid to be supplied to both chambers. However, it brings a problem in terms of the cost and a problem of more complex mechanism in terms of the production.

Further, when liquid is supplied to the compression working chambers, it is necessary to supply sufficient liquid to the discharge side of the compression working chambers since the temperature of gas gradually increases toward the discharge side of the compression working chambers due to the compression action. Since the compression working chambers are in an environment in which the pressure increases toward the discharge side, it is necessary for the supply pressure of liquid to be sufficiently high. Especially, where the liquid supply port for fine particles in the form of mist described hereinabove is applied, a sufficient supply pressure for securing the diffusibility and the supply amount of lubricant to the compression working space on the discharge side on which the pressure is higher is necessitated.

A technology for a flow path configuration that can efficiently supply liquid to a compressor body including compression working chambers and a bearing chamber is demanded.

Means for Solving the Problem

In order to solve the subject described above, for example, the configuration described in the claims is applied. That is, a compressor body includes a compression mechanism including at least one screw rotor that compresses gas; a casing that accommodates the compression mechanism and defines a compression working chambers therein; a suction side bearing that rotatably supports the at least one screw rotor; a bearing chamber that accommodates the suction side bearing therein; and at least one liquid supply port that communicates with the compression working chambers and supplies liquid supplied from an outside of the casing into the compression working chambers, in which the casing has an internal liquid supply flow path that extends from a discharge side of the compression working chambers as an upstream side to a suction side of the compression working chambers as a downstream side and that supplies the liquid to the at least one liquid supply port, and the internal liquid supply flow path has a first flow path whose downstream portion reaches the bearing chamber, the first flow path being configured to supply the liquid to the suction side bearing.

Advantages of the Invention

According to the one aspect of the present invention, efficient liquid supply taking into consideration the viscosity of liquid to be supplied to the bearing chamber can be performed.

The other problems, configurations, actions, and advantageous effects of the present invention become apparent from the following description.

MODES FOR CARRYING OUT THE INVENTION

In the following, modes for carrying out the present invention is described in detail with reference to the drawings.

Although the present invention can be applied to compressors that compress gas, embodiments are described in connection with an air compressor.

First Embodiment

Figure 1:
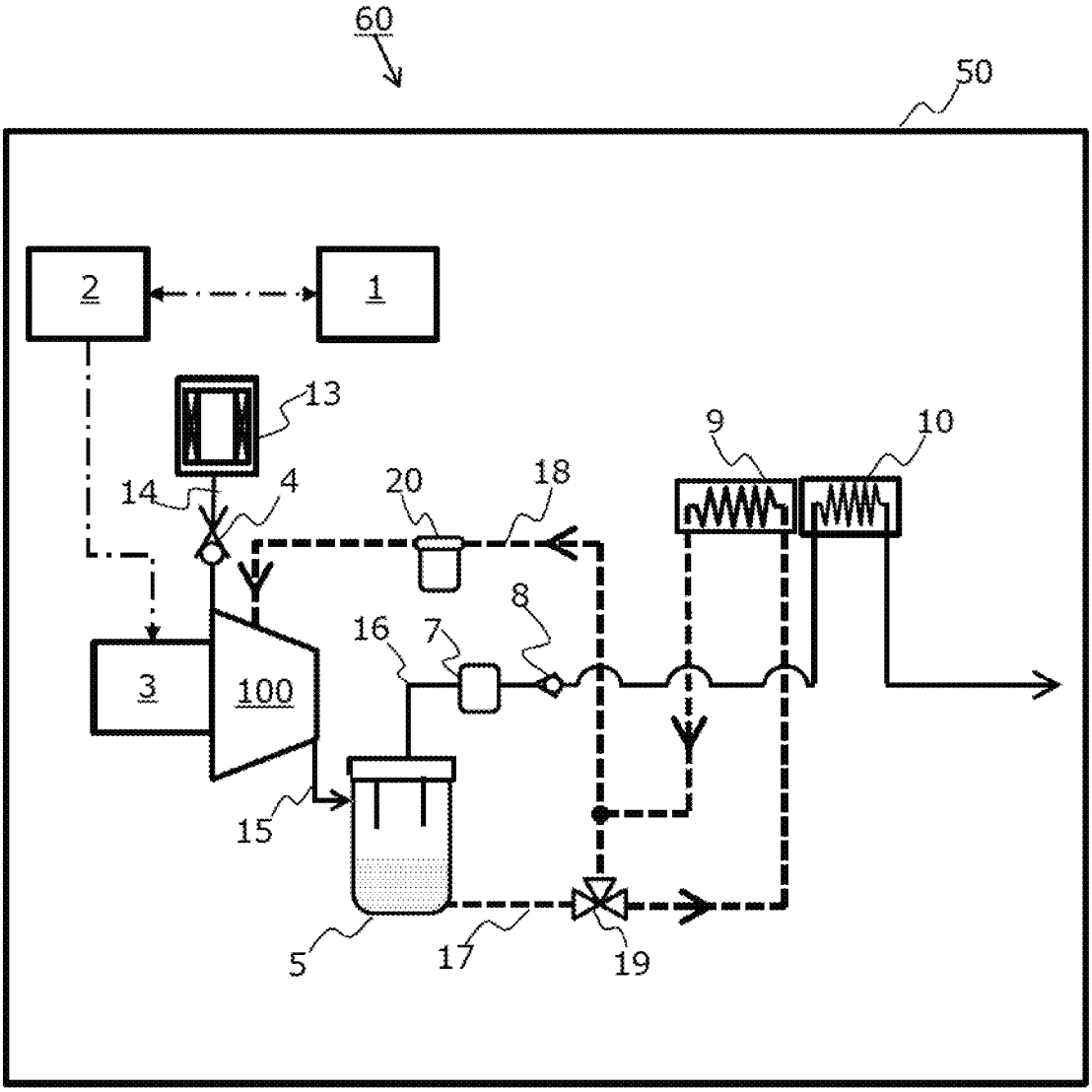
FIG. 1 is a diagram schematically depicting a configuration of an air compressor according to a first embodiment to which the present invention is applied.

FIG. 1 depicts a general configuration of an air compressor 60 (hereinafter referred to sometimes merely as "compressor 60") that is an embodiment to which the present invention is applied. The compressor 60 is a compressor of the liquid flooded type in which liquid such as oil or water is supplied to a compressor body 100 for cooling of compressed air, lubrication, or the like. In the description of the present embodiment, the compressor is described as a compressor of the oil flooded type in which oil is used. The compressor 60 includes a controller 1, an electric power conversion device 2, a driving source 3, a suction throttle valve 4, a gas-liquid separator 5, an oil cooler 9, an air cooler 10, a discharge pipe 15, an air discharge pipe 16, oil circulation flow paths 17 and 18, a three-way valve 19, and the compressor body 100. The compressor 60 is a compressor of the so-called package type in which such components as mentioned above are placed in the inside of a housing 50.

The controller 1 performs various kinds of control of the compressor 60. For example, the controller 1 includes a computation device that cooperates with software to implement various functions and executes operation control of the compressor 60. Note that also it is possible to apply a controller that partly has an analog configuration. The controller 1 is communicatable with pressure sensors and temperature sensors arranged on the discharge pipe 15 and the air discharge pipe 16, and outputs a predetermined frequency command value to the electric power conversion device 2 in response to detected pressures and temperatures. Further, the controller 1 is communicatably connected to the suction throttle valve 4 and the three-way valve 19 and configured to dynamically perform opening and closing (including half opening) of valve bodies of them.

The electric power conversion device 2 converts a power supply not depicted into that of a predetermined frequency transmitted thereto from the controller 1 and supplies the electric power to an electric motor serving as the driving source 3. In the present embodiment, the controller 1 and the electric power conversion device 2 perform operation control by P, PI, or PID control with reference to a set pressure in response to a discharge pressure and a temperature of the compressor body 100. Further, the controller 1 executes no-load operation in response to the consumption amount of compressed air. Specifically, if the discharge pressure rises to a predetermined pressure, then the controller 1 performs operation for saving the power load by closing the suction throttle valve 4 to restrict the suction air amount to the compressor body 100, causing compressed air on the upstream side of an air release solenoid valve (not depicted) arranged on the air discharge pipe 16 to be released from the air release solenoid valve to the atmospheric air or the like, and further reducing the rotation speed of the driving source 3 to a low level (for example, to a predetermined lowest rotation speed or the like). It is to be noted that the no-load operation in the present embodiment is not limited to this, but may be applied an operation method implemented by providing either one of the suction throttle valve 4 and an air release solenoid valve and by opening or closing either one of them. Further, in a case where the compressor 60 is a fixed speed machine that does not use the electric power conversion device 2, an operation method may be applied in which both or one of the suction throttle valve 4 and the air release solenoid valve is opened or closed without reducing the rotation speed of the driving source 3.

Although the driving source 3 is an electric motor, the present invention can be applied also to other driving sources. As such other driving sources, an internal combustion engine, a steam engine, an engine that utilizes natural energy such as wind power and water power, or the like may be applied. Where any of such driving sources as mentioned above other than an electric motor is utilized, in order to change the rotation speed of the driving source 3, in place of the electric power conversion device 2, a switchable transmission with gears may be used or, where an internal combustion engine or the like is used, a mechanism for controlling drive fuel supply for the engine or the like may be used.

The suction throttle valve 4 is a valve body that controls the gas amount to flow into the compressor body 100. with compressor air discharged from the compressor body 100 as a control pressure. For example, the suction throttle valve 4 is a valve body in the form of a piston, which is operated by the control pressure to perform opening and closing of a suction gas flow path 14. Note that also it is possible to apply a solenoid valve to the suction throttle valve 4. Alternatively, the suction throttle valve 4 may be a valve body that changes its opening not only between two stages of open and closed but also freely.

The gas-liquid separator 5 is a separator of the centrifugal type or the collision type and primarily separates mixed compressed gas of air and oil discharged from the compressor body 100 into compressed air and oil. In the present embodiment, an gas-liquid separator of the centrifugal type is applied. The gas-liquid separator 5 is configured principally from an outer tube forming an outer shell and an inner tube arranged in the inside of the outer tube. Mixed compressor gas flows in the outer tube and is separated into compressed air and oil by swirling along the inner wall of the outer tube.

The separated compressed air passes the inner tube and flows into the air discharge pipe 16. The separated oil is stored on the bottom of the gas-liquid separator 5 and is returned to the compressor body 100 through the oil circulation paths 17 and 18 and the oil cooler 9. Meanwhile, the separated compressed air flows into the air discharge pipe 16. Thereafter, the compressed air flows via a secondary filter 7 and a pressure control valve 8 to the air cooler 10 which is arranged on the downstream side of them, and the compressed air cooled to a predetermined temperature is supplied to the outside of the compressor 60.

The oil circulation flow path 17 and the oil circulation flow path 18 are connected to each other via the three-way valve 19. The three-way valve 19 is a solenoid valve and is a valve body that switches the flow path for oil flowing in the oil circulation flow path 17 to the oil cooler 9 side or the oil circulation flow path 18 side according to an output from the controller 1. For example, the controller 1 switches, where the temperature of oil primarily separated by the gas-liquid separator 5 and stored in the bottom thereof is higher than a predetermined temperature, the three-way valve 19 so as to cause the oil to flow to the oil cooler 9 side and flow to the oil circulation flow path 18 after it is cooled sufficiently. When the oil temperature is equal to or lower than the predetermined temperature, the controller 1 controls the three-way valve 19 such that the oil flows to the oil circulation flow path 18 without passing the oil cooler 9 thereby to prevent overcooling of the oil. It is to be noted that, in the embodiment, the oil cooler 9 and the air cooler 10 can be configured by applying a cooler of any of the air cooled type and the water cooled type.

The oil supplied to the compressor body 100 is circulated utilizing the pressure of compressed air discharged from the compressor body 100. It is to be noted that it is possible to apply a configuration in which a pressure feed pump is arranged on the oil circulation paths 17 and 18.

Now, a configuration of the compressor body 100 is described with reference to FIGS. 2 to 7. The compressor body 100 has a screw rotor arranged as a compression mechanism therein. The compressor body 100 is connected to the oil circulation flow path 18 (refer to FIG. 1) such that oil is supplied to compression working chambers and bearings that rotatably support the screw rotor. It is to be noted that, although the present embodiment uses a configuration composed of a pair of male and female screw rotors, the present invention is not limited to this.

Figure 2:
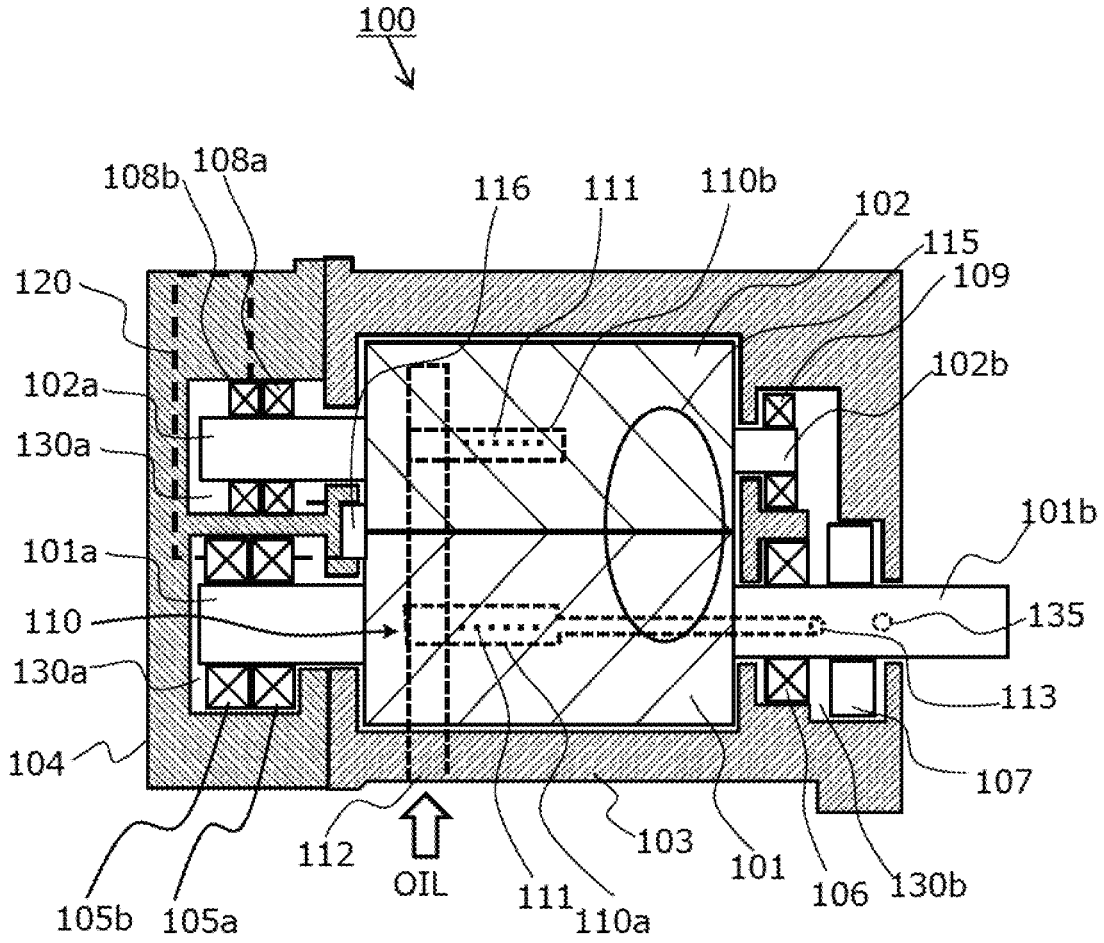
FIG. 2 is a view schematically depicting a longitudinal section in an axial direction of a configuration of a compressor body according to the first embodiment as viewed from an intake side.
Figure 3:
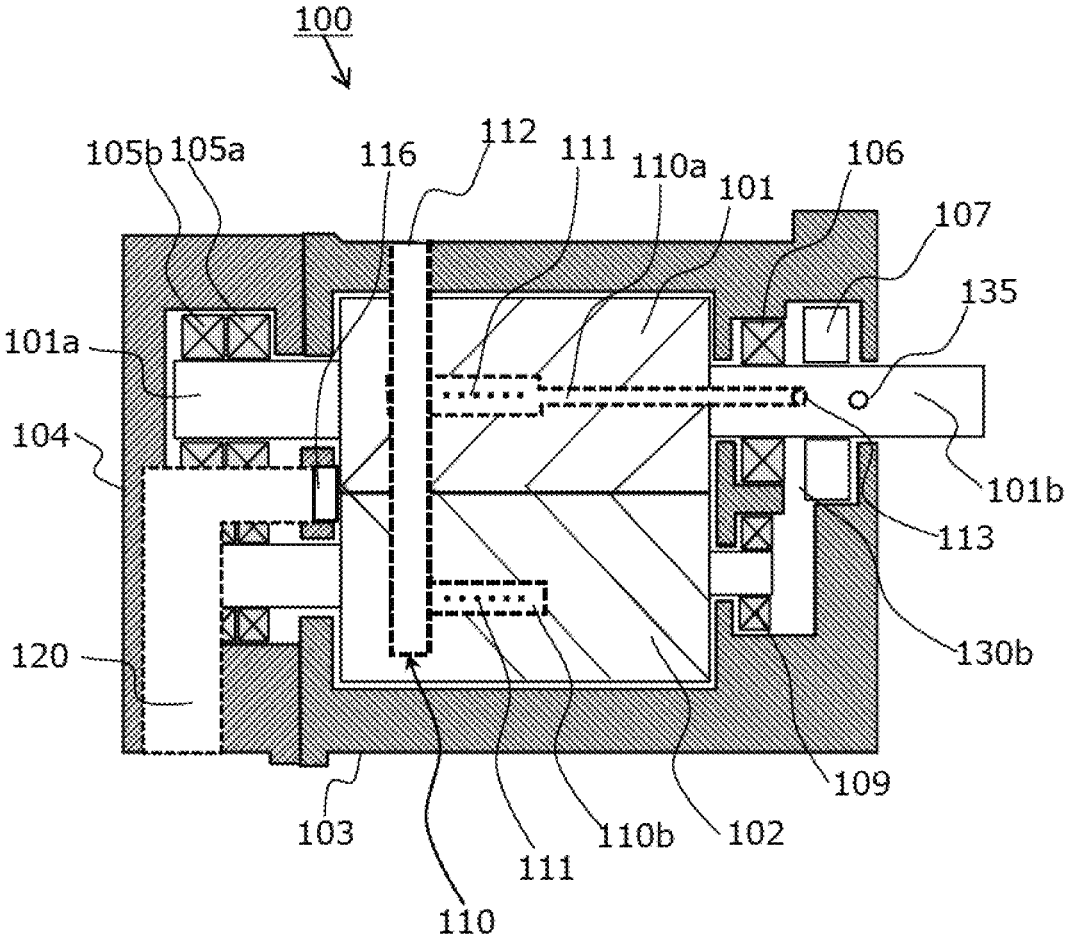
FIG. 3 is a view depicting a longitudinal section in the axial direction of the configuration of the compressor body according to the first embodiment as viewed from the opposite side to the intake side.

FIG. 2 schematically depicts a configuration of a cross section in an axial direction of the compressor body 100 as viewed from an intake 115 side. Referring to FIG. 2, the left side is the discharge side and the right side is the suction side, and the front face side is the intake 115 side for the atmospheric air. Meanwhile, FIG. 3 schematically depicts a configuration of a cross section in the axial direction of FIG. 2 as viewed from the opposite side to the intake 115 (from the rear face side of FIG. 2). Also in FIG. 3, the left side is the discharge side and the right side is the suction side similarly as in FIG. 2.

The compressor body 100 includes a pair of screw rotors of a male rotor 101 and a female rotor 102, and further includes a body casing 103 having a predetermined bore space that accommodates the screw rotors. Air sucked in from the intake 115 is compressed by meshing engagement of lobes and grooves of the male rotor 101 and the female rotor 102. The compressed air is discharged to the discharge pipe 15 (refer to FIG. 1) via a discharge port 116 through a discharge flow path 120 together with oil supplied to the compression working space. It is to be noted that the compression chambers are formed on the back side of the male rotor 101 and the female rotor 102 in FIG. 2.

The male rotor 101 and the female rotor 102 include rotor shafts 101*a* and 101*b* and rotor shafts 102*a* and 102*b*, respectively. The rotor shaft 101*a* of the male rotor 101 is rotatably supported by discharge side bearings 105*a* and 105*b* on a discharge side casing 104 connected to the discharge side of the body casing 103. Meanwhile, the rotor shaft 101*b* of the male rotor 101 is rotatably supported by a suction side bearing 106 on the suction side of the body casing 103. It is to be noted that the rotor shaft 101*b* is connected for power transmission to the driving source 3.

By rotation of the male rotor 101 and the female rotor 102, air sucked in from the intake 115 is compressed and is discharged from the discharge flow path 120 to the discharge pipe 15 via the discharge port 116 together with oil supplied to the compression working chambers.

The discharge flow path 120 has such a flow path configuration that it extends on the downstream side thereof from the discharge port 116 to the lower side of the bearings 105*a* and 105*b* and bearings 108*a* and 108*b* (on the rear face side of the intake 115) and is bent midway toward a side face in a direction orthogonal to the axial direction while gradually increasing the inner diameter (refer to FIG. 3 and so forth). It is to be noted that the shape of the discharge flow path 120 is not limited to this but may be such a shape that it extends in a substantially axial direction from the discharge port 116. Also the discharge port may be structured as an axial port, a radial port, or a port of both of them and is optional.

Also the female rotor 102 is configured similarly such that the rotor shaft 102*a* is rotatably supported by discharge side bearings 108*a* and 108*b* on the discharge side casing 104 and the rotor shaft 102*b* is rotatably supported by a suction side bearing 109 on the suction side of the body casing 103. It is to be noted that, to the bearings mentioned, a bearing according to specifications such as a ball bearing, a roller bearing, a thrust bearing, or a slide bearing can be applied. Also the numbers of bearings on the suction side and the discharge side are not limited to those of the example described above but are optional.

To a bearing chamber 130*b* of the body casing 103 in which the suction side bearings 106 and 109 are accommodated, oil is supplied from an internal oil supply flow path 110 hereinafter described. Further, the rotor shaft 101*b* of the male rotor 101 is provided with a seal 107 such that oil is prevented from leaking out along the rotor shaft from the bearing chamber 130*b*. As the seal 107, a seal member that contacts or does not contact the rotor shaft 101*b* is applied, and, for example, a labyrinth seal or a screw seal can be applied. It is to be noted that, although one seal 107 is arranged in the present embodiment, the number of such seals 107 is not limited to this but is optional.

An oil recovery path 135 is an oil path for recovering oil leaking out from the seal 107 to the driving source 3 side. The recovered oil flows out to the primary side of the suction throttle valve 4 through a pipe (not depicted). In the present embodiment, the compressor 60 is configured to execute no-load operation. Usually, the bearing chamber 130*b* has a tendency that it becomes a negative pressure a little lower than the atmospheric pressure due to the suction action of the compression chambers and oil is less likely to leak from the seal 107 to the driving source 3 side. However, upon no-load running, a pressure higher than the atmospheric pressure is sometimes applied to the bearing chamber 130*b* due to a back pressure from the discharge side, and in such a case as just described, oil sometimes leaks out from the seal 107 to the driving source 3 side. The leaked out oil can be recovered by the oil recovery path 135.

One of characteristics of the present embodiment is that the body casing 103 has the internal oil supply flow path 110 along which oil is circulated.

Figure 4:
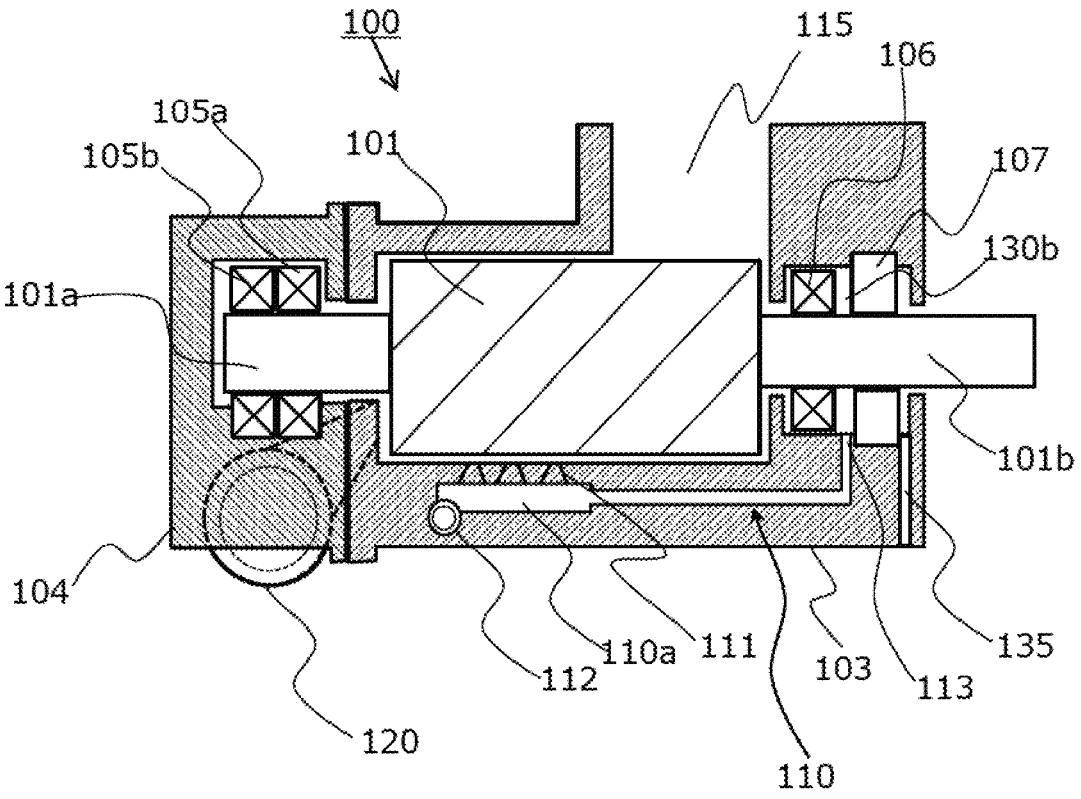
FIG. 4 is a view schematically depicting a longitudinal section in the axial direction of the configuration of the compressor body according to the first embodiment as viewed from one side face side.
Figure 5:
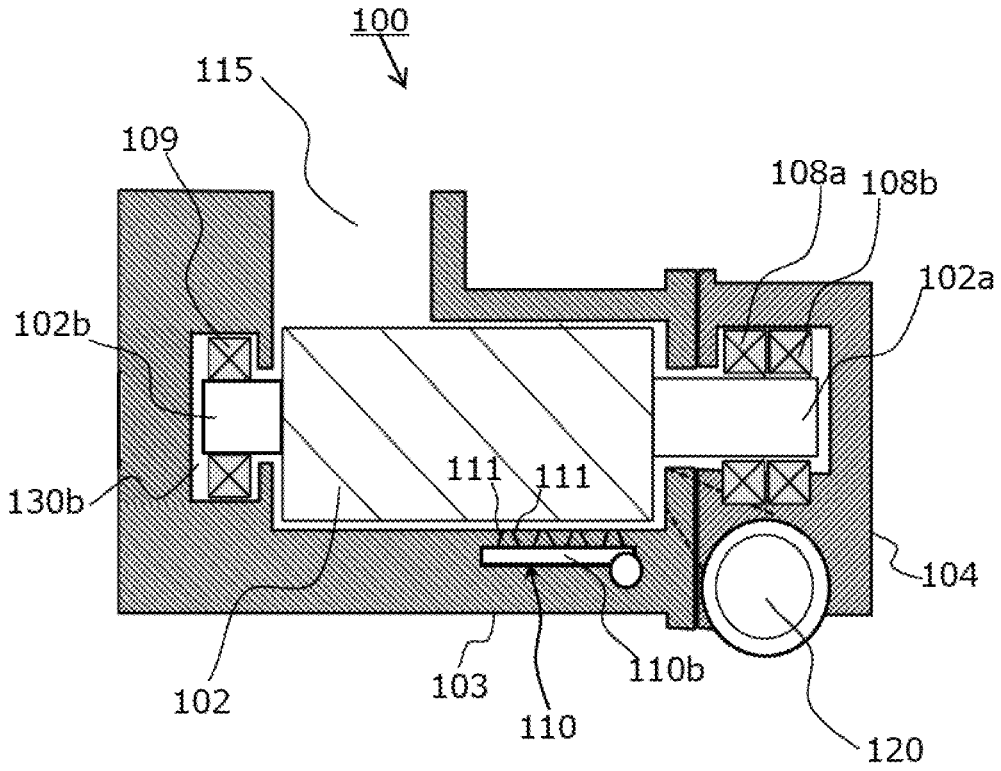
FIG. 5 is a view schematically depicting a longitudinal section in the axial direction of the configuration of the compressor body according to the first embodiment as viewed from the other side face side.

FIGS. 4 and 5 schematically depict cross sections in the axial direction of the compressor body 100 in a case of viewing the compressor body 100 from side face sides in the axial direction. In FIG. 4, the left side is the discharge side and the right side is the suction side. In FIG. 5, the left side is the suction side and the right side is the discharge side. In FIG. 4, the body casing 103 has, on the compression working room side (which is a region corresponding to a region where the compression working chambers become in a compression process and is a portion on the lower side in FIGS. 4 and 5), the internal oil supply flow path 110 that extends from the discharge side to the suction side. The internal oil supply flow path 110 extends in parallel to the extension direction of the male rotor 101 and the female rotor 102 and in the axial direction in the inside of the body casing 103. The internal oil supply flow path 110 has an internal oil supply flow path entrance 112 to which the oil circulation flow path 18 (refer to FIG. 1) is connected such that oil is supplied into the inside thereof. The internal oil supply flow path 110 has one flow path that extends in the penetration direction from the internal oil supply flow path entrance 112 across the male rotor 101 and the female rotor 102 against the axial direction and two flow paths 110*a* and 110*b* that branch in a direction parallel to the male rotor 101 and the female rotor 102 from the extending flow path and that extend in the axial direction.

The internal oil supply flow path 110*a* of the two flow paths, extending in the axial direction below the male rotor 101, extends to the bearing chamber 130*b* and communicates through the internal oil supply flow path exit 113. On the other hand, the internal oil supply flow path 110*b* extending in the axial direction below the female rotor 102 extends near the center of the female rotor 102 in the axial direction but does not communicate with the bearing chamber 130*b*.

Further, the two internal oil supply flow paths 110*a* and 110*b* extending in the axial direction have a plurality of oil supply ports 111 that communicate with the bore space of the body casing 103 toward the male rotor 101 or the female rotor 102. Specifically, as one of the characteristics of the present embodiment, oil supply to the compressor body 100 is performed through the internal oil supply flow path 110 such that oil is supplied into the compression working chambers on the upstream side of the internal oil supply flow path 110 and lubricating oil for the bearings is supplied to the bearing chamber 130*b* on the downstream side of the internal oil supply flow path 110.

Such a configuration of the internal oil supply flow path 110 as just described demonstrates such advantageous effects as described below.

Firstly, such an advantageous effect is that lubricating oil with low viscosity can be supplied to the bearings 106 and 109 on the suction side can be listed. The compression working chambers becomes higher in temperature on the discharge side than on the suction side due to a compression action. Due to this, the body casing 103 is more likely to become higher in temperature on the discharge side. Oil flowing along the internal oil supply flow path 110 is raised in temperature and decreased in viscosity as it firstly flows through the relatively high temperature portion of the body casing 103. Therefore, agitation loss of the lubricating oil can be reduced at the suction side bearings 106 and 109.

Secondly, such an advantageous effect that oil can be injected to the compression working chambers on the discharge side, which is in a higher pressure environment, with a sufficiently high pressure from the oil supply ports 111 can be listed. Specifically, where a plurality of oil supply ports 111 are arranged in the axial direction, the pressure of oil to be injected from an oil supply port 111 on the upstream side of the internal oil supply flow path 110 is higher than the pressure of oil to be injected from an oil supply port 111 on the downstream side. In other words, there is an advantageous effect that oil can be sufficiently supplied with a higher injection pressure to a region where the pressure is higher in the compression working chambers and with a relatively lower injection pressure to a region where the pressure is relatively lower.

Thirdly, such an advantageous effect that, in a region of the compression working chambers in which the compressed air is highest in temperature, compressed air can be cooled with oil of the lowest temperature can be listed. Further, the configuration of the present embodiment acts also for decrease in temperature on the discharge side of the discharge side casing 104, body casing 103, male rotor 101, and female rotor 102 and thereby contributes also to preventing from expansion of the gap between the rotor and the bore inner wall due to thermal expansion of the casing on the discharge side. The configuration can be also expected to have an advantageous effect of preventing from decrease in compression efficiency.

Figure 6:
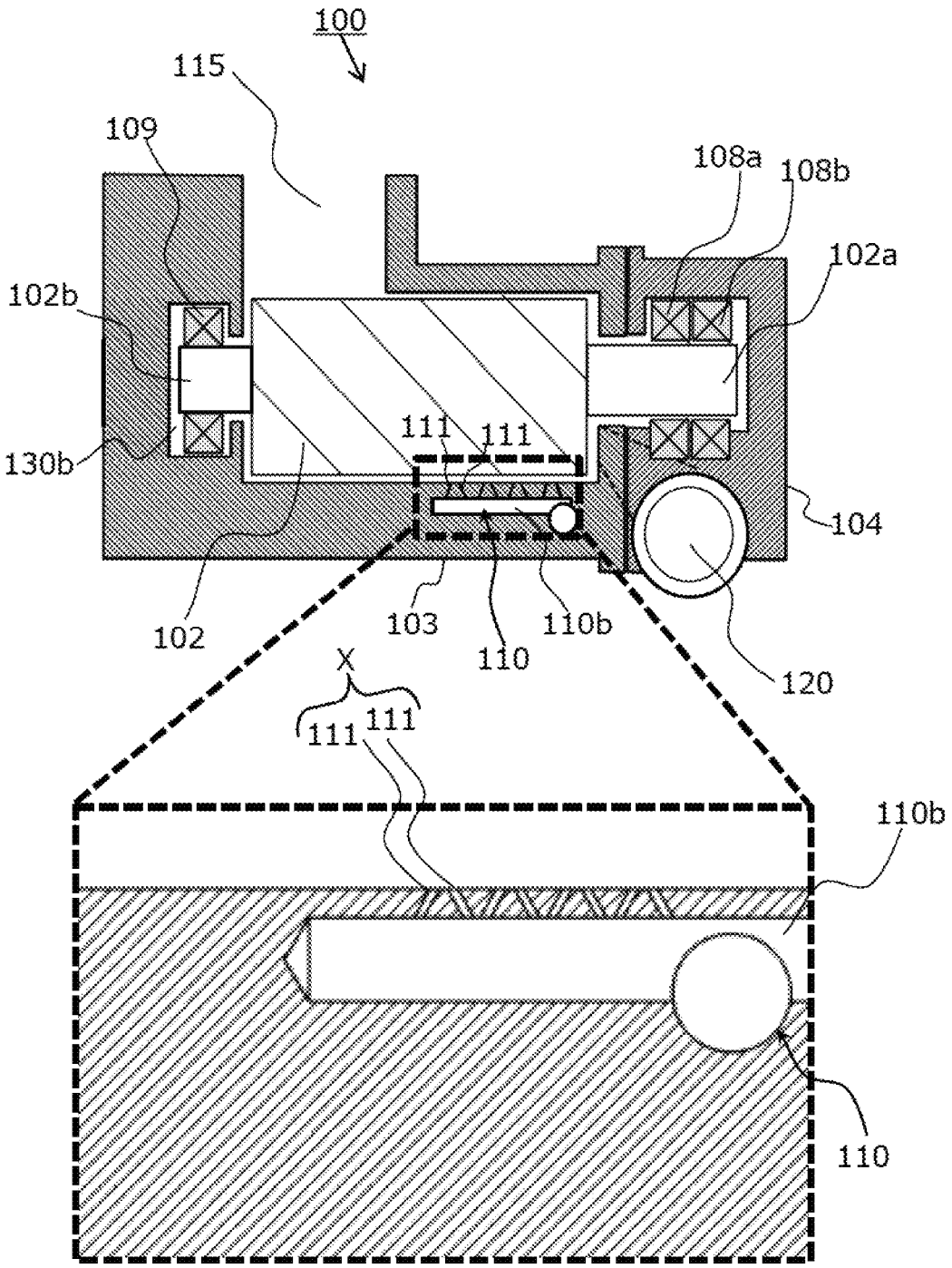
FIG. 6 is a view schematically depicting the longitudinal section in the axial direction of the configuration of the compressor body according to the first embodiment as viewed from the other side face side and depicting an oil supply port area in a partly enlarged scale.

Finally, the oil supply ports 111 of the present embodiment are described. FIG. 6 schematically depicts a longitudinal section of the compressor body depicted in FIG. 5 and an enlarged view (broken line portion) of a periphery of the oil supply ports 111. The oil supply ports 111 are flow paths that are inclined such that extensions of oil injection directions of adjacent ones of the oil supply ports 111 cross each other on the compression working chamber side. The compressor body 100 has a plurality of oil supply ports X (hereinafter referred to sometimes as "mist nozzles X") that are formed of two adjacent holes of which are paired with each other and diffuse oil in the form of mist in the compression working chambers by collision of the oil injected from the paired holes (the present example is configured such that each of the two flow paths 110*a* and 110*b* extending in the axial direction has four pairs of mist nozzles X).

Figure 7:
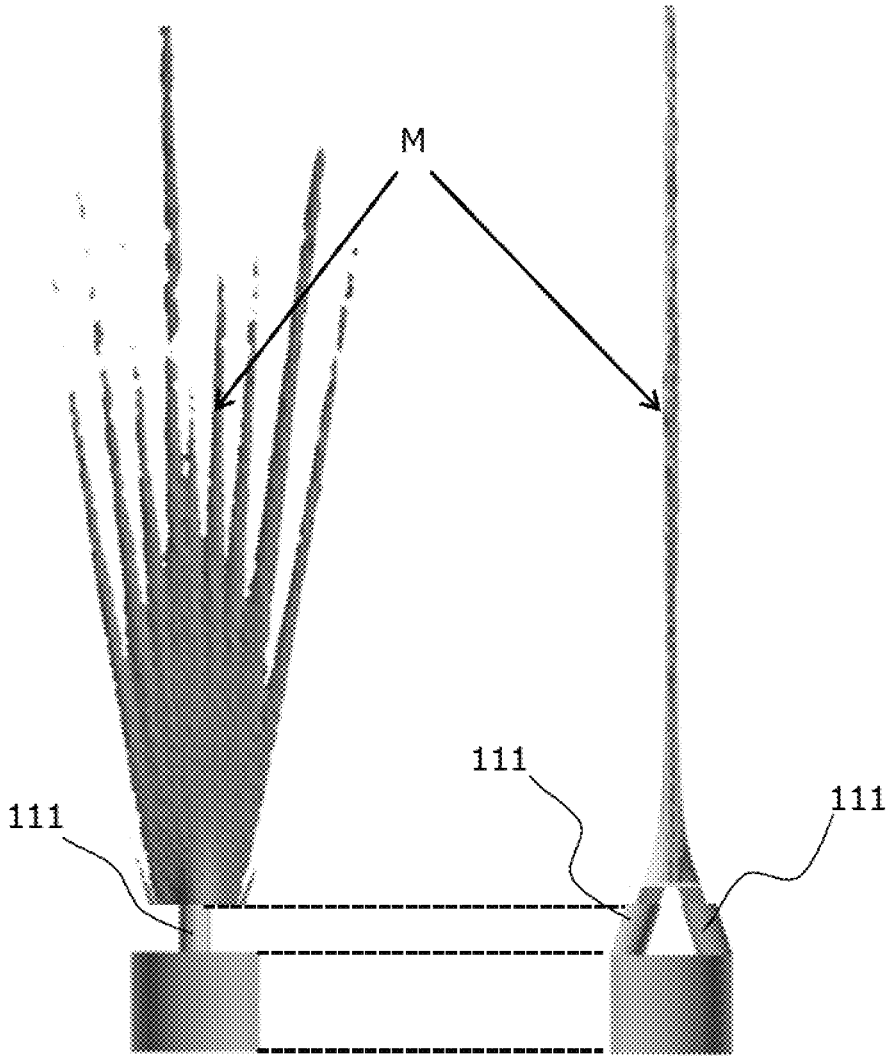
FIG. 7 is a view schematically depicting an oil supply port according to the first embodiment and a state of oil diffusing in the form of mist.

FIG. 7 schematically depicts a state in which oil injected from a mist nozzle X diffuses in the form of mist. Referring to FIG. 7, the left side depicts the state of the oil as the mist nozzle X is viewed from the axial direction, and the right side depicts the state of the oil as the mist nozzle X is viewed in a direction orthogonal to the axial direction from a side face of the compressor body 100. As the oil M diffuses in the form of mist, oil particles are refined, and improvement of the heat exchange efficiency with compressed air can be anticipated with this configuration. When oil M of such a form of mist as just described is to be generated, as the momentum of the oil injected from the two oil supply ports 111 paired with each other increases, the particle size of the oil M in the form of mist can be reduced. It is possible to increase the momentum of the injection, for example, by decreasing the diameter of the individual oil supply ports 111 from that of oil supply ports of a single hole and/or by providing a higher pressure by the internal oil supply flow path 110, or the like. In this regard, it is considered that the configuration of the present embodiment is preferable because the mist nozzles X are provided in a region where a comparatively high injection pressure on the upstream side of the internal oil supply flow path 110 can be expected.

It is to be noted that, although the present embodiment exemplifies the mist nozzles X each configured from two oil supply ports 111, also it is possible to apply a mist nozzle X configured from three or more oil supply ports 111. The present invention is not limited to the mist nozzles X, and also it is possible to apply oil supply ports of a single hole or apply both single holes and mist nozzles X (in the case of both, also it is considered preferable for the cooling of compressed air and adjustment of the total amount of oil supply to the compression working chambers that the mist nozzles X are arranged on the discharge side and the single holes are arranged on the suction side).

Embodiment 2

Figure 8:
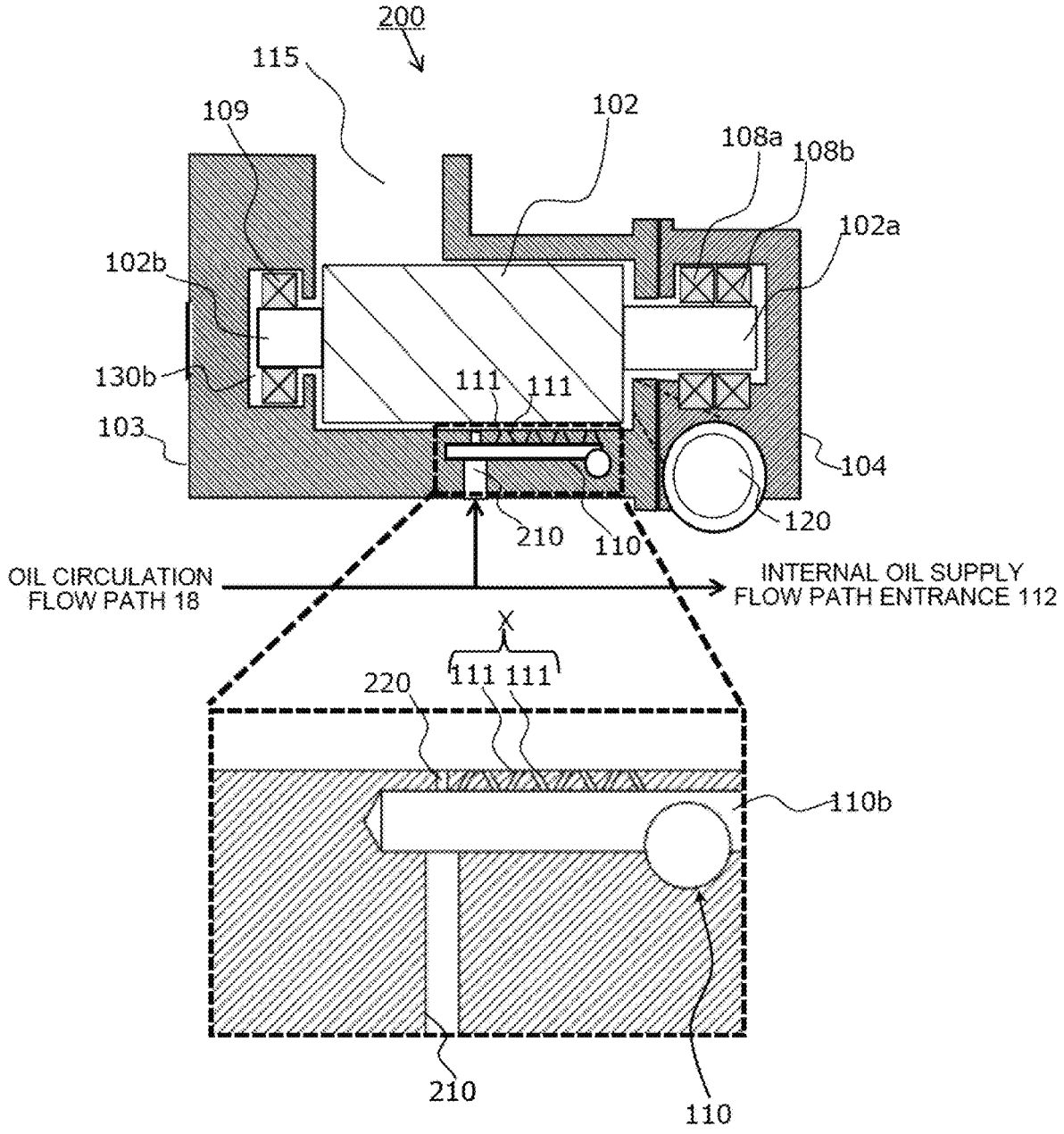
FIG. 8 is a view schematically depicting a longitudinal section in an axial direction of a configuration of a compressor body according to a second embodiment as viewed from a side face side and depicting an oil supply port area in a partly enlarged scale.

In the following, an oil supply system for a compressor body 200 according to a second embodiment is described. A view on an upper side of FIG. 8 schematically depicts a cross section in an axial direction of the compressor body 200 as viewed from a side face direction, and a view on a lower side of FIG. 8 schematically depicts an enlarged cross section of a periphery of oil supply ports 111. It is to be noted that like components to those in the first embodiment are denoted by the same reference characters and detailed description of them is sometimes omitted.

The compressor body 200 has one of characteristics in that it includes a circulation flow path branching from the oil circulation flow path 18. Specifically, while the oil circulation flow path 18 is connected to an internal oil supply flow path entrance 112 as in the first embodiment, it branches on the upstream side with respect to the internal oil supply flow path entrance 112 and is connected also to a low pressure side oil supply flow path 210 arranged in the body casing 103 of the compressor body 200.

The low pressure side oil supply flow path 210 is an oil supply flow path that communicates with the compression working chambers and an outside from a direction orthogonal to the axial direction of the body casing 103. A single hole 220 arranged on the low pressure side oil supply flow path 210 is an oil supply port arranged in a comparatively lower pressure region (on the suction side) of the compression working chambers and functions also for adjustment of the total amount of oil supply to the compression chambers. For example, if the diameter of the oil supply ports 111 is small in order to secure an injection pressure of the mist nozzles X, then an oil amount necessary for cooling of compressed air, lubrication of the screw rotors, and so forth may become insufficient as a whole. In such a case as just described, if oil is supplied also from the single hole 220 of the low pressure side oil supply flow path 210 that can covers the shortage of oil, then performance deterioration can be prevented. It is to be noted that the low pressure side oil supply flow path 210 and the single hole 220 may be arranged not only below the female rotor 102 but also below the male rotor 101, and also the number of them is optional.

Although the mode for carrying out the present invention has been described so far, the present invention is not limited to the various examples described above and can be altered in various manners without departing from the subject matter of the present invention.

First, although, in the embodiments described above, one pair of male and female screw rotors are applied as the compression mechanism, the present invention can be applied also to a configuration that is composed of a single screw rotor (including those in which gate rotors are used) and a configuration that is composed of three or more screw rotors. Further, the number of compressor bodies 100 or 200 is not limited to one, and the compressor may be a multistage compressor that includes two or more compressor bodies. Further, although, in the description of the embodiments, the compressor is described as a variable speed machine that uses the electric power conversion device 2, it may otherwise be a constant speed compressor.

Further, although, in the embodiments, the internal oil supply flow path 110 is configured such that it firstly extends in a direction orthogonal to the axial direction in the body casing 103 and then extends in the axial direction on extensions in a diametrical direction of the male rotor 101 and the female rotor 102, the present invention is not limited to such a flow path position as just described, and the arrangement configuration of flow paths can be made optional if they have such a positional relation that the discharge side is the upstream and the suction side is the downstream in the body casing 103.

Further, although, in the embodiments, the oil supply ports 111 are configured such that they are arranged on vertical lower side extensions from the center axial lines of the male rotor 101 and the female rotor 102, they may be configured otherwise such that they are arranged at positions displaced in a rotation direction from the center axial lines.

DESCRIPTION OF REFERENCE CHARACTERS

1: Controller
2: Electric power conversion device
3: Driving source
4: Suction throttle valve
5: Gas-liquid separator
7: Secondary filter
8: Pressure control valve
9: Oil cooler
10: Air cooler
13: Air filter
14: Suction gas flow path
15: Discharge pipe
16: Air discharge pipe
17, 18: Oil circulation flow path
19: Three-way valve
20: Oil filter
50: Housing
60: Air compressor
100, 200: Compressor body
101: Male rotor
101*a*, 101*b*: Rotor shaft
102: Female rotor
102*a*, 102*b*: Rotor shaft
103: Body casing
104: Discharge side casing
105*a*, 105*b*: Discharge side bearing
106: Suction side bearing
107: Seal
108*a*, 108*b*: Discharge side bearing
109: Suction side bearing
110 (110*a*, 110*b*): Internal oil supply flow path
111: Oil supply port
112: Internal oil supply flow path inlet
113: Internal oil supply flow path outlet
115: Intake
116: Discharge port
120: Discharge flow path
130*b*: Bearing chamber
135: Oil recovery path
210: Low pressure side oil supply flow path
220: Single hole

The invention claimed is:

1. A compressor body comprising:

a compression mechanism including at least one screw rotor that compresses gas;

a casing that accommodates the compression mechanism and defines compression working chambers therein;

a suction side bearing that rotatably supports the at least one screw rotor;

a bearing chamber that accommodates the suction side bearing; and at least one liquid supply port that communicates with the compression working chambers, the at least one liquid supply port being configured to supply liquid supplied from an outside of the casing into the compression working chambers, wherein the casing has an internal liquid supply flow path that extends from a discharge side of the compression working chambers as an upstream side to a suction side of the compression working chambers as a downstream side, the internal liquid supply flow path being configured to supply the liquid to the at least one liquid supply port, and the internal liquid supply flow path has a first flow path whose downstream portion reaches the bearing chamber, the first flow path being configured to supply the liquid to the suction side bearing, wherein the internal liquid supply flow path includes a second flow path that is branched from the first flow path, and the second flow path extends from the discharge side of the compression working chambers as an upstream side to the suction side of the compression working chambers as an downstream side without communicating with the bearing chamber, and has a second liquid supply port that is configured to supply the liquid into the compression working chambers.

2. The compressor body according to claim 1, wherein the first flow path axially extends in parallel to the at least one screw rotor in the casing.

3. The compressor body according to claim 1, wherein the at least one screw rotor comprises at least one male screw rotor and at least one female screw rotor that compress gas by meshing engagement of lobes and grooves thereof, and the first flow path extends along an extension direction of one of the at least one male screw rotor and the at least one female screw rotor while the second flow path extends along an extension direction of another of the at least one male screw rotor and the at least one female screw rotor.

4. The compressor body according to claim 1, wherein the at least one liquid supply port is configured to diffuse the liquid in a form of mist toward the compression working chambers.

5. The compressor body according to claim 4, wherein the at least one liquid supply port comprises at least two holes, liquid supply directions of the at least two holes crossing each other toward the compression working chambers, and the at least one liquid supply port is of a impingement diffusion type that make the liquid supplied from the at least two holes impinge on each other so as to diffuse the liquid in the form of mist in the compression working chambers.

6. The compressor body according to claim 5, wherein, the at least one liquid supply port comprises a plurality of liquid supply ports.

7. The compressor body according to claim 4, wherein the internal liquid supply flow path has a liquid supply port of a single hole different from the at least one liquid supply port, the liquid supply port of a single hole communicates with a lower pressure side of the compression working chambers on the internal liquid supply flow path, and the at least one liquid supply port communicates with a higher pressure side of the compression working chambers with respect to the liquid supply port of a single hole on the internal liquid supply flow path.

8. The compressor body according to claim 1, wherein the casing has a liquid supply flow path different from the internal liquid supply flow path, the liquid supply flow path being configured to make the compression working chambers communicate with an outside of the compressor body such that the liquid is supplied to the compression working chambers through an external pipe, and another liquid supply port that is arranged on the liquid supply flow path is configured to supply the liquid to a lower pressure side of the compression working chambers with respect to the at least one liquid supply port that the internal liquid supply flow path has.

9. The compressor body according to claim 1, wherein the gas to be compressed is air.

10. The compressor body according to claim 1, wherein the liquid is oil or water.

11. A compressor comprising the compressor body according to claim 4.

* * * * *